US011891716B2

(12) United States Patent
Lapelosa

(10) Patent No.: US 11,891,716 B2
(45) Date of Patent: Feb. 6, 2024

(54) ELECTROLYTICALLY ACTING DOCTOR BLADE FOR PICKLING AND CLEANING CURVED METAL SURFACES

(71) Applicant: NITTY-GRITTY SRL, Sassuolo (IT)

(72) Inventor: Marco Lapelosa, Sassuolo (IT)

( * ) Notice: Subject to any disclaimer, the term of this patent is extended or adjusted under 35 U.S.C. 154(b) by 559 days.

(21) Appl. No.: 17/266,603

(22) PCT Filed: Aug. 5, 2019

(86) PCT No.: PCT/IT2019/050181
§ 371 (c)(1),
(2) Date: Feb. 7, 2021

(87) PCT Pub. No.: WO2020/031219
PCT Pub. Date: Feb. 13, 2020

(65) Prior Publication Data

US 2021/0310147 A1 Oct. 7, 2021

(30) Foreign Application Priority Data

Aug. 6, 2018 (IT) ..... 102018000007869

(51) Int. Cl.
*C25B 11/00* (2021.01)
*C25F 7/00* (2006.01)
*C25F 1/04* (2006.01)

(52) U.S. Cl.
CPC . *C25F 7/00* (2013.01); *C25F 1/04* (2013.01)

(58) Field of Classification Search
CPC ..... C25B 11/00; C25F 1/04; C25F 7/00
See application file for complete search history.

(56) References Cited

U.S. PATENT DOCUMENTS 4,609,450 A * 9/1986 Seimiya ..... B23H 5/06 204/217
2012/0006691 A1* 1/2012 Luo ..... B23H 7/26 204/224 R
2015/0014173 A1* 1/2015 Lapelosa ..... B23H 9/06 204/198

* cited by examiner

*Primary Examiner* — Zulmariam Mendez
(74) *Attorney, Agent, or Firm* — Patshegen IP; Moshe Pinchas

(57) ABSTRACT

An electrolytically acting doctor blade for pickling and cleaning curved metal surfaces comprises an electrode (2, 26, 34) embodied by a metal wire (8, 32) around which a pad (7, 30) made of a felt-like absorbent plastic material, resistant to high temperatures and to the chemicals contained in the electrolytic solution used, is wrapped; gripping means of the doctor blade on the electrode over the length of the face (F) of the doctor blade; electrical connection of the ends of the metal wire (8, 32) by means of a power supply electric cable (16) to initiate the electrolytic action; and has the gripping means of the doctor blade (1) on the electrode (2, 26, 34) connected to each other by the means placed alongside, in which the connection section, in the deformable body of the doctor blade (3) which has been made pliable, is oriented towards the face (F) of the doctor blade; a push or pull mechanism acts on the ends (25) of the doctor blade and, to obtain a reaction, with a middle part of the mechanism, connected to the middle part of the deformable body of the doctor blade (3), deforms the face of the doctor blade from rectilinear into the arched, convex or concave conformation, depending on the pull or push on the ends of the doctor blade, with respect to the middle part of the doctor blade, exerted by the said mechanism.
Different constructive forms of electrolytically acting doctor blade for pickling and cleaning curved metal surfaces with the use of different deformable electrodes are described.

10 Claims, 8 Drawing Sheets

Fig. 3
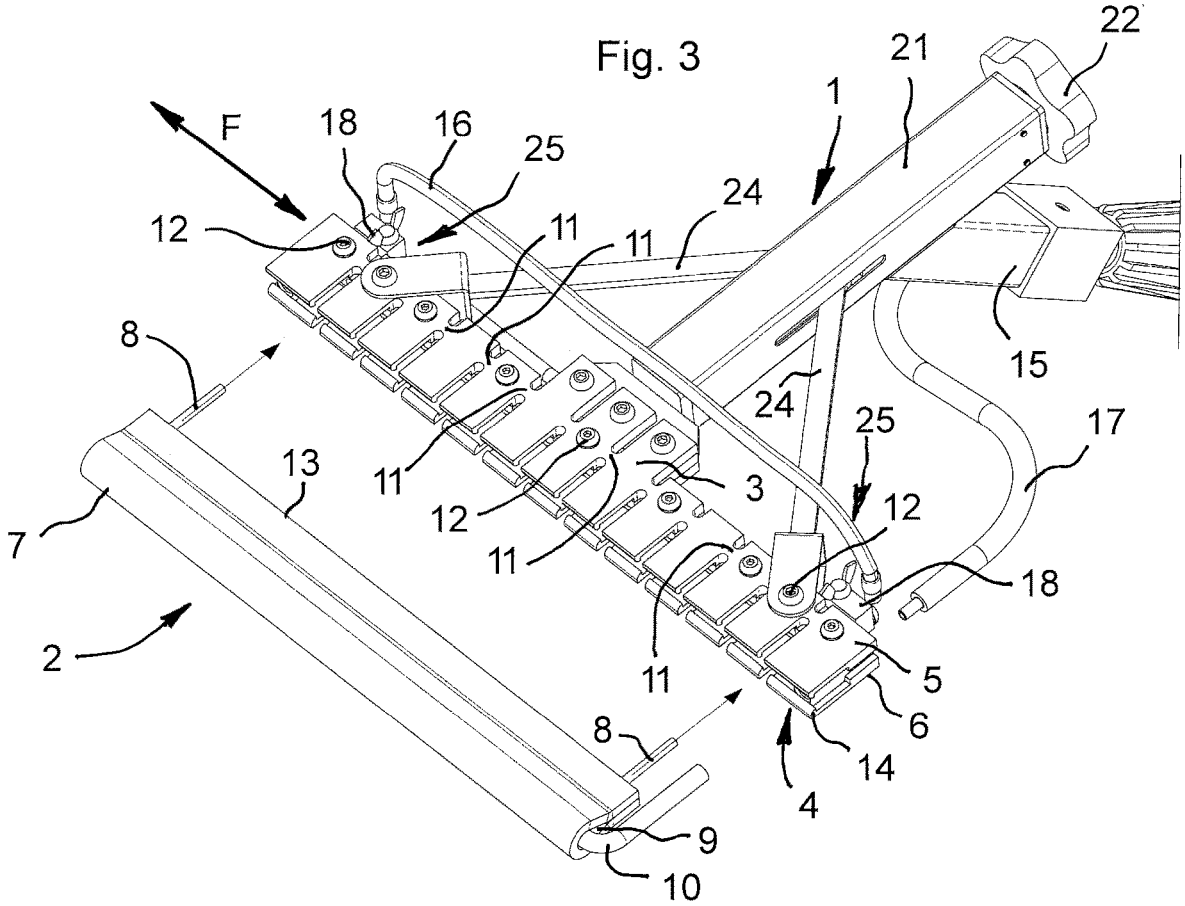
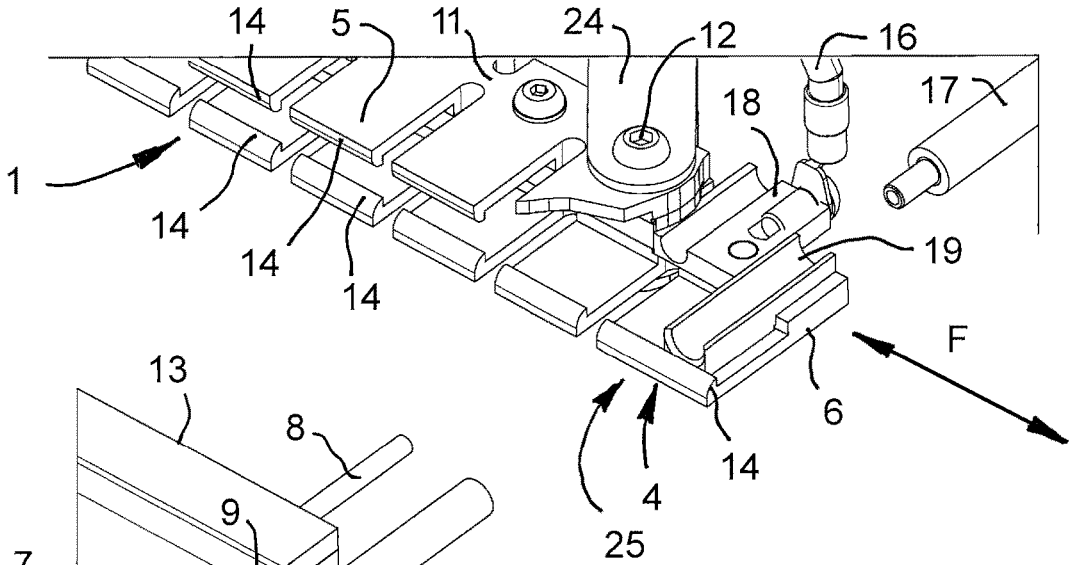
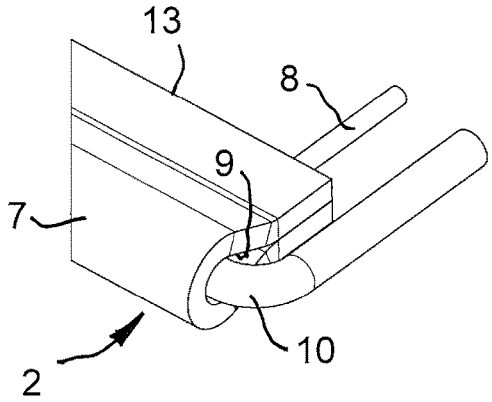
Fig. 4

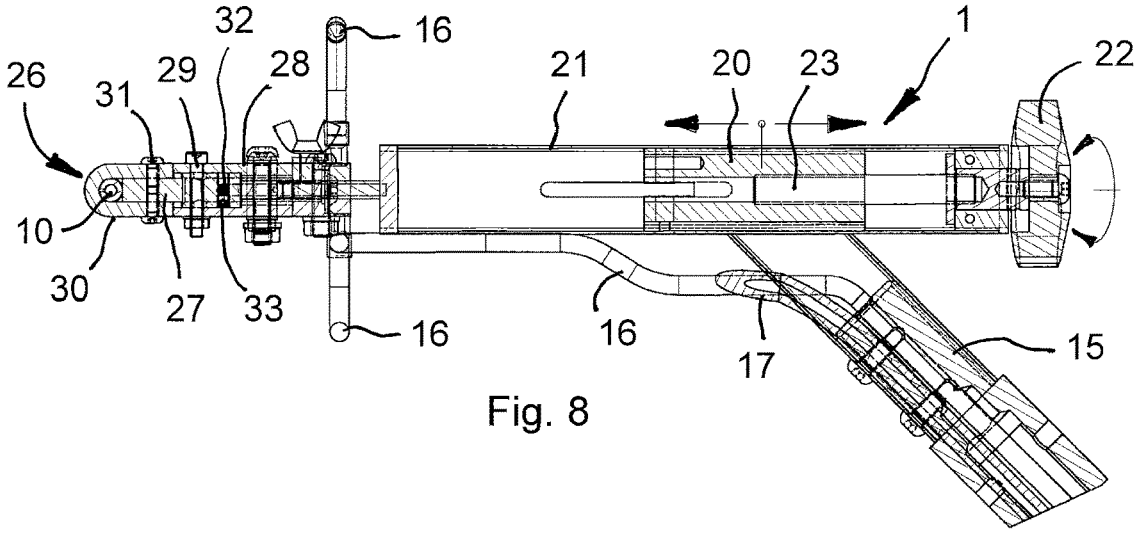
Fig. 8
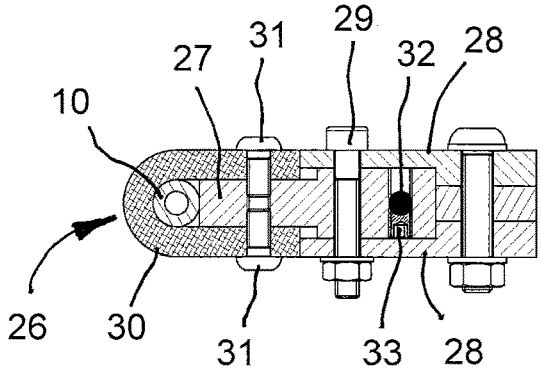
Fig. 9
Fig. 10
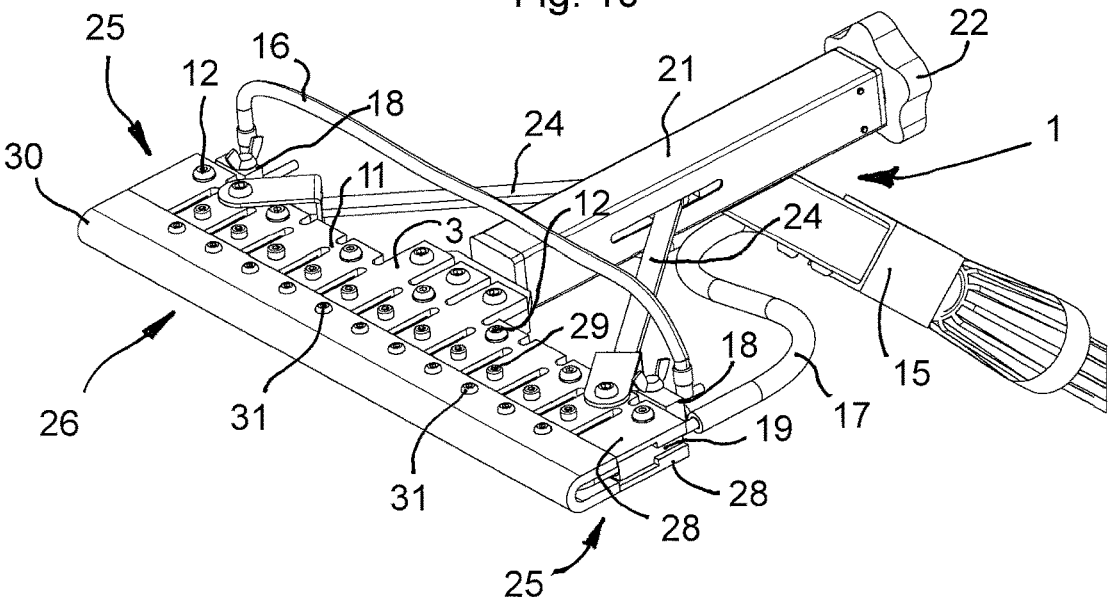

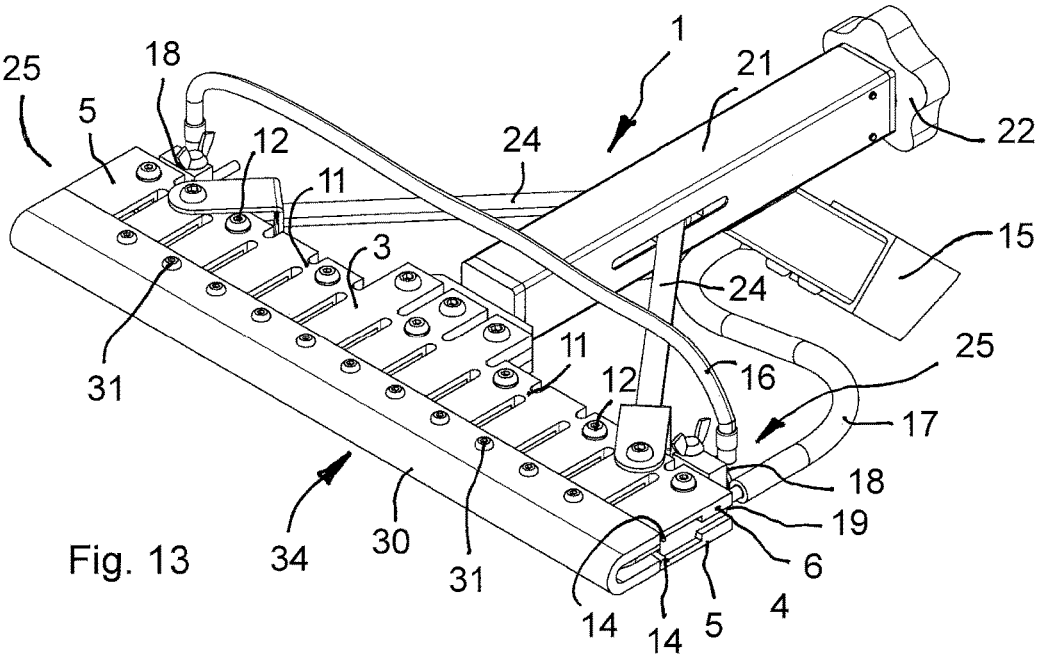
Fig. 13
Fig. 14
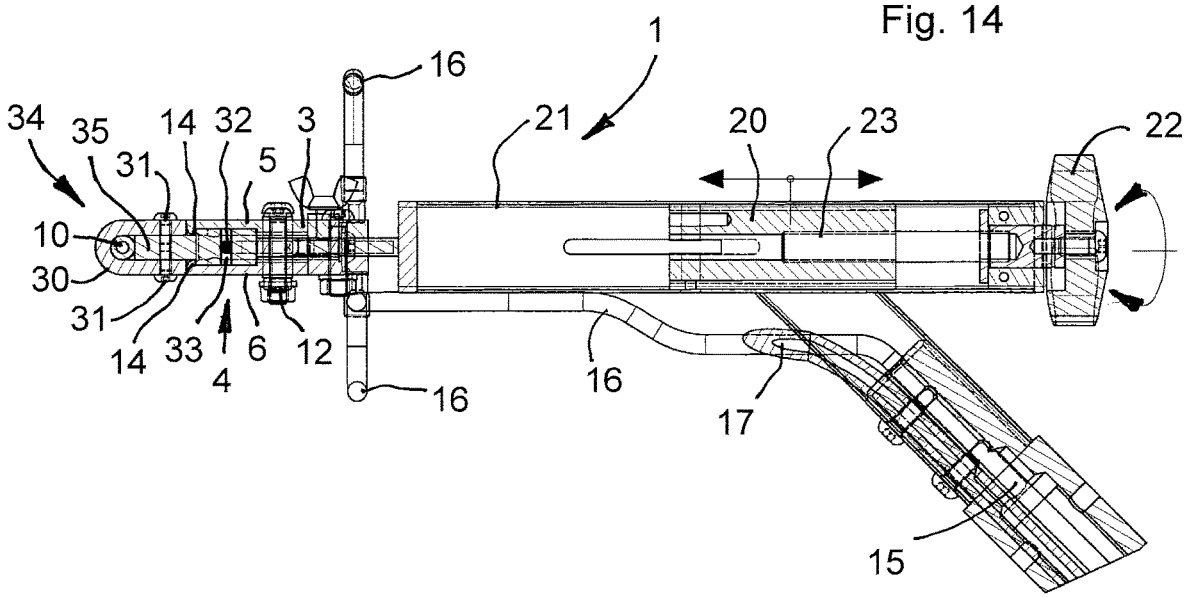

ELECTROLYTICALLY ACTING DOCTOR BLADE FOR PICKLING AND CLEANING CURVED METAL SURFACES

FIELD OF APPLICATION

The present invention relates to an electrolytically acting doctor blade for pickling and cleaning curved metal surfaces, i.e., to the conformation of a doctor blade which, by applying the known electrolytic action to pickle or clean metal surfaces by means of an electrolytic solution suitable to the surface being treated and to the type of deposit to be removed, allows to perform said treatment on curved surfaces, whether they are convex, i.e., with the doctor blade having a concavity, or concave, i.e., with the doctor blade having a convexity adapted to the curvature of the surface being treated.

BACKGROUND ART

The prior art includes rectilinear doctor blades used for electrolytically pickling the metal surfaces to be treated, which are comprised of a basically rigid body of the doctor blade so as to act on the convex surface in a limited area of the length of the edge of the doctor blade itself. Moreover, such rectilinear doctor blades, when used on concave surfaces to be treated, can operate only by arranging the direction of the edge of the doctor blade parallel to the generatrix of the concave or convex curved surface. Actually, this electrolytic pickling operation is performed for the external cleaning, i.e., of the convex cylindrical surface, or the internal one, i.e., of the concave cylindrical surface, of tanks, reservoirs, containers and the like for liquids of a variety of food and non-food stuff, where said surfaces require a careful removal of deposits, dirt, scales or patinas, both internal and external, which with use are formed on the metal surface of the tanks, reservoirs and containers themselves.

The aforementioned doctor blades are used by connecting the body of the doctor blade, or electrode, to one end of the electric circuit for initiating the pickling electrolytic action, and the other electric end being connected or placed in electric contact with the surface to be treated. A pad, made of a woven material resistant to the heat generated during the treatment, generally connected and movable together with the body of the doctor blade itself, which is soaked in an electrolytic solution suitable to the surface being treated and the type of scale, dirt, patina or deposit to remove, is interposed between the doctor blade and the surface. The electrolytic solution can soak the pad by submerging it or by being supplied with a pump and a tube for feeding the solution from a reservoir connected or attached to the electric apparatus providing supply to the pickling circuit of the doctor blade.

Therefore, in the background art there are no known doctor blades which, by combining the aforementioned features required for doctor blades which are suitable and used in the electrolytic pickling of metal surfaces, show features of adaptability to the surfaces with curvatures to be treated, to operate on a treatment surface or face corresponding to the length of the doctor blade itself, making it practically usable by the user both as a doctor blade to be used with a manual handle and as a doctor blade to be used at the end of a swinging rod, which the user takes up to reach more easily areas which are far from his working point on the surface being treated.

In the art, in the field of general surface cleaning doctor blades, a doctor blade with such a conformation as to make the rubber edge, in contact with the surface being treated, flexible and deformable when contacting the curved surface upon which the user drags it is known from document US 2002/100135 A1. It is provided with an end of the rubber edge in which there are angles of inclination in the upper part of the edge towards the attachment to the gripping handle of the doctor blade itself: these angles make the end itself of the doctor blade pliable, either at one end or at the opposite end, thus allowing the adaptation of the edge to a concave surface being treated, i.e., making the edge convex; alternatively, the said edge is made with a certain concavity, at the middle part of the edge itself, so as to facilitate the concave conformation of the edge of the doctor blade, also centrally exploiting the flexibility of the rubber edge, and to allow the doctor blade to operate on convex surfaces to be treated.

In fact, the main limitation of the prior art solution described herein is that the doctor blade is not intended for any electrolytic pickling treatment, therefore it does not suggest any means for transforming a doctor blade known in the art of metal surface electrolytic pickling with a structure and/or conformation replacing the rubber edge with the pad soaked in the electrolytic solution required for the metal surface picking treatment, implementing the electrolytic activation of the pickling of the surface involved in the treatment.

Such prior art may be significantly improved as to the possibility of providing an electrolytically acting doctor blade for pickling and cleaning curved metal surfaces, which overcomes the aforementioned limitations of the background art.

Therefore, the technical problem underlying the present invention is to provide an electrolytically acting doctor blade for pickling and cleaning curved metal surfaces which enables the curvature of the doctor blade, while maintaining the presence of the electrode, as in the rectilinear doctor blade known in the art, and of the pad interposed between the electrode and the surface being treated.

An object inherent in the above technical problem is to provide a doctor blade having a deformable structure in such a way that the concave or convex conformation may be achieved in a rapid, simple and reversible manner.

A further and not least object of the present invention is to provide the possibility of replacing the electrode in the doctor blade having a deformable structure in a quick and simple manner and/or the single pad mounted thereon.

SUMMARY OF THE INVENTION

This problem is solved, according to the present invention, by an electrolytically acting doctor blade for pickling and cleaning curved metal surfaces comprising an electrode made with a metal wire around which a pad made of a felt-like absorbent plastic material, resistant to high temperatures and to the chemicals contained in the electrolytic solution used, is wrapped; gripping means of the doctor blade on the electrode over the length of the face of the doctor blade; electrical connection of the ends of the metal wire by means of a power supply metal cable to initiate the electrolytic action; characterised in that the gripping means of the doctor blade on the electrode are connected to each other by the means placed alongside, in which the connection section, in the deformable body of the doctor blade which has been made pliable, is oriented towards the face of the doctor blade; a push or pull mechanism acts on the ends of the doctor blade and, to obtain a reaction, with a middle part of the mechanism, which is connected to the middle part of the body of the doctor blade, deforms the face of the doctor blade from rectilinear into the arched, convex or concave conformation, depending on the pull or push on the ends of the doctor blade, with respect to the middle part of the deformable body of the doctor blade, exerted by the said mechanism.

In a further constructive form, the push or pull mechanism is placed in the middle of the doctor blade and connected thereto, and has a rail in which a slider is made movable in the push or pull mechanism aligned with the rail; the slider is connected to each of the two ends of the doctor blade by means of rods having a predetermined length.

Furthermore, in an improved constructive form, the slider of the push or pull mechanism is actuated by a screw mechanism with a manual gripping member in a position opposite to the connection between the rail of the slider and the middle part of the doctor blade.

Furthermore, in a specific and preferred embodiment, a handle of the doctor blade is connected to the aforementioned rail of the slider and has a metal cable for the electrical connection to the said metal wire of the electrode.

Moreover, in a further alternative constructive form, if there is an inner pipe for feeding the electrolytic solution in the electrode, on at least one end of the doctor blade there is a connection between the inner pipe and a pipe for supplying the electrolytic solution.

Furthermore, in a specific improved embodiment, at both ends of the doctor blade, a terminal is provided to connect the end of the metal wire of the electrode to the electrical connection metal cable in at least one of them; from one end to the other of the doctor blade, there is an electrical connection metal cable acting as a U-bolt between the said terminals.

Also, in a further advantageous constructive form, the gripping means of the doctor blade are tightened onto the electrode and have gripping teeth on the dorsal end of the electrode.

Furthermore, in an alternative constructive form, a carbon fibre braid in contact with the metal wire of the electrode and the inner surface of the pad is interposed between the pad and the metal wire of the electrode.

Finally, instead of the preceding alternative constructive form, graphite elements, which are tightened onto the metal wire of the electrode and in contact with the inner surface of the pad, are interposed between the pad and the metal wire of the electrode.

Further features and advantages of the present invention, in the production of an electrolytically acting doctor blade for pickling and cleaning curved metal surfaces, will be apparent from the following description of some constructive forms and embodiments, given by way of non-limiting example, with reference to the eight attached drawings.

BRIEF DESCRIPTION OF THE DRAWINGS

FIG. 3 shows a perspective and schematic view of the doctor blade of FIG. 1 with the electrode in the assembly step in the deformable clamp of the doctor blade;

FIG. 4 shows a perspective, schematic, partially sectioned and limited view of FIG. 1 at the end of the electrode and the corresponding assembly position of the end of the electrode in the clamp of the doctor blade;

FIG. 8 shows a schematic section of the doctor blade of FIG. 1 as an axial section of the doctor blade in which the internal mechanism for adjusting the curvature and a further graphite electrode conformation may be seen;

FIG. 9 shows an enlarged schematic sectional view of the electrode made of graphite in the constructive form of FIG. 8;

FIG. 10 shows an enlarged schematic perspective view of the doctor blade of FIG. 8;

FIG. 13 shows a perspective and schematic view of the doctor blade with the electrode having graphite elements in a constructive form usable with the doctor blade of FIGS. 1-5;

FIG. 14 shows a schematic axial sectional view of the doctor blade of FIG. 13, in which the internal mechanism for adjusting the curvature may be seen;

DETAILED DESCRIPTION OF SOME PREFERRED EMBODIMENTS

Figure 1:
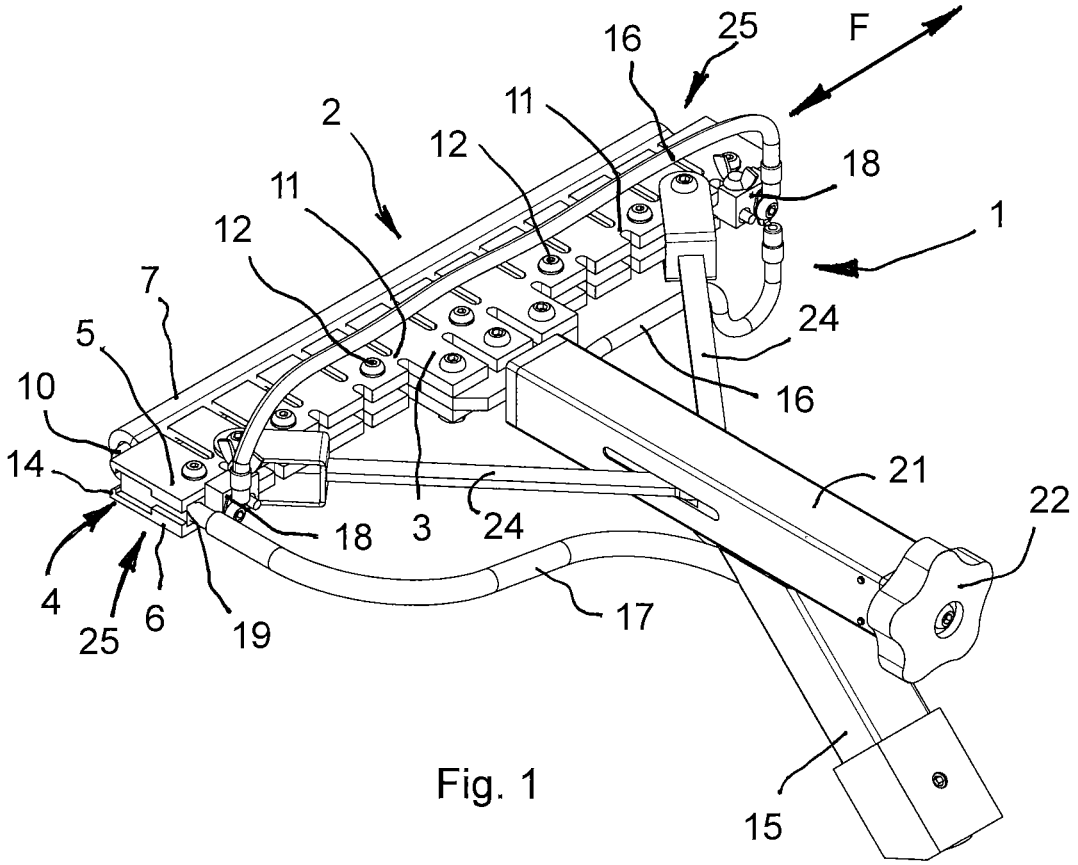
FIG. 1 shows a perspective and schematic view of an electrolytically acting doctor blade for pickling and cleaning curved metal surfaces, according to the invention, seen from the user's side.
Figure 2:
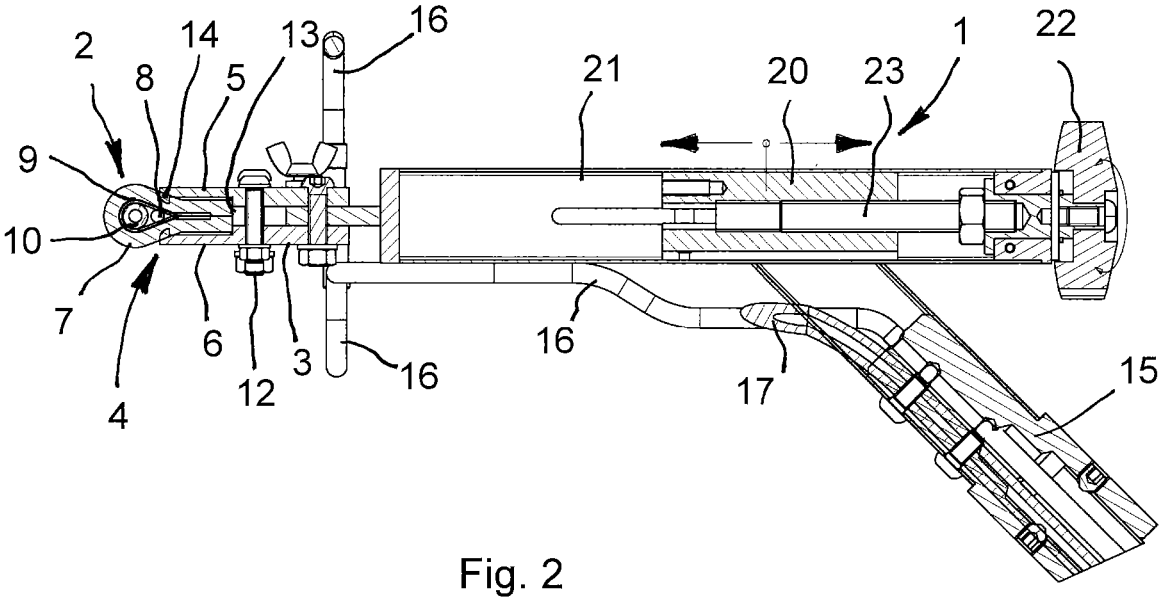
FIG. 2 shows a schematic axial sectional view of the doctor blade of FIG. 1 in which the internal mechanism for adjusting the curvature and the cross-section of an electrode mounted on the doctor blade may be seen.
Figure 5:
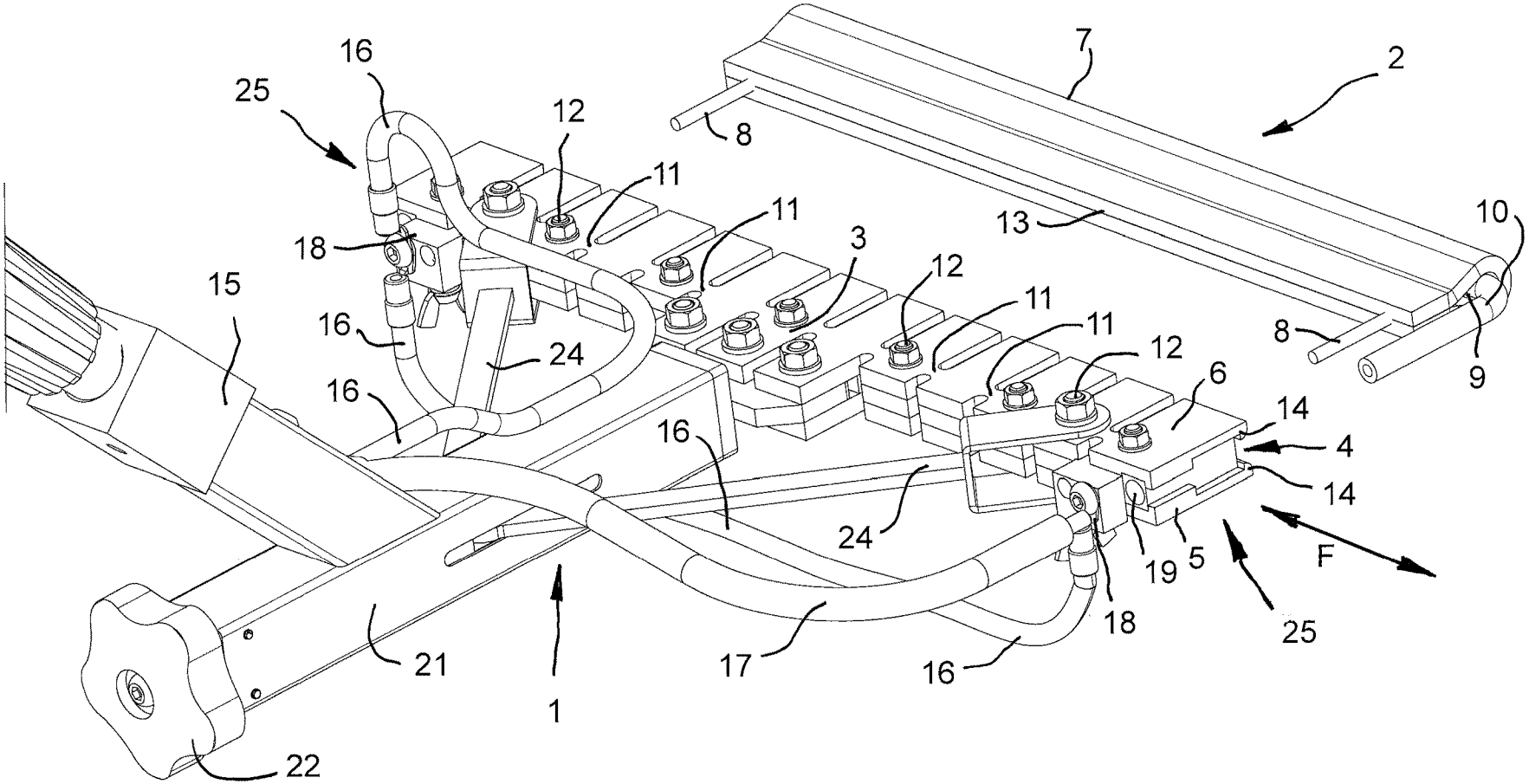
FIG. 5 shows a perspective and schematic view of the doctor blade of FIG. 1 in which the doctor blade is turned upside down to show the electrical connections and the connections for supplying the electrolytic solution.

FIGS. 1 to 5 show a doctor blade 1 according to the invention, in which a deformable electrode 2 is supported and guided by a deformable body 3 of the doctor blade made up of upper 5 and lower 6 clamping elements 4, which, when tightened, grab the deformable electrode 2. The illustrated deformable electrode comprises a pad 7 for winding a metal wire 8, conducting the electric current, with a carbon fibre braid 9 interposed to cover the inner surface of the pad; the deformable electrode is completed by an inner pipe 10 for feeding the electrolytic solution to the said braid 9 for covering the pad so as to generate the electrolytic action between the metal wire 8 of the electrode, the carbon fibre braid 9 and the surface being treated, in contact with the pad 7 soaked in an electrolytic solution.

The deformable body 3 of the doctor blade 1 is made by tightening the clamping elements 4 placed side by side and joined, in the direction F of the face of the doctor blade, by connections 11 between upper clamping elements 5 and also between lower clamping elements 6, so as to achieve an increased pliability of the material forming the said clamping elements, concentrated in such connections 11, tightening means 12, acting between the said upper and lower clamping elements, which, when tightened, grab the dorsal end 13 of the deformable electrode 2 by means of teeth 14 on the outer surface of the pad 7 of such dorsal end.

A metal cable 16 for the electrical connection to the electrode and a pipe 17 for supplying the electrolytic solution to the doctor blade come out from the handle 15 of the doctor blade 1. In the end clamping elements 4 of the face of the doctor blade 1, there are an electrical connection terminal 18 at each end, for supplying power to the metal wire 8, and, at least at one end, a connection 19 between the supplying pipe 17 and the inner pipe 10 for feeding the electrolytic solution into the pad.

Figure 6:
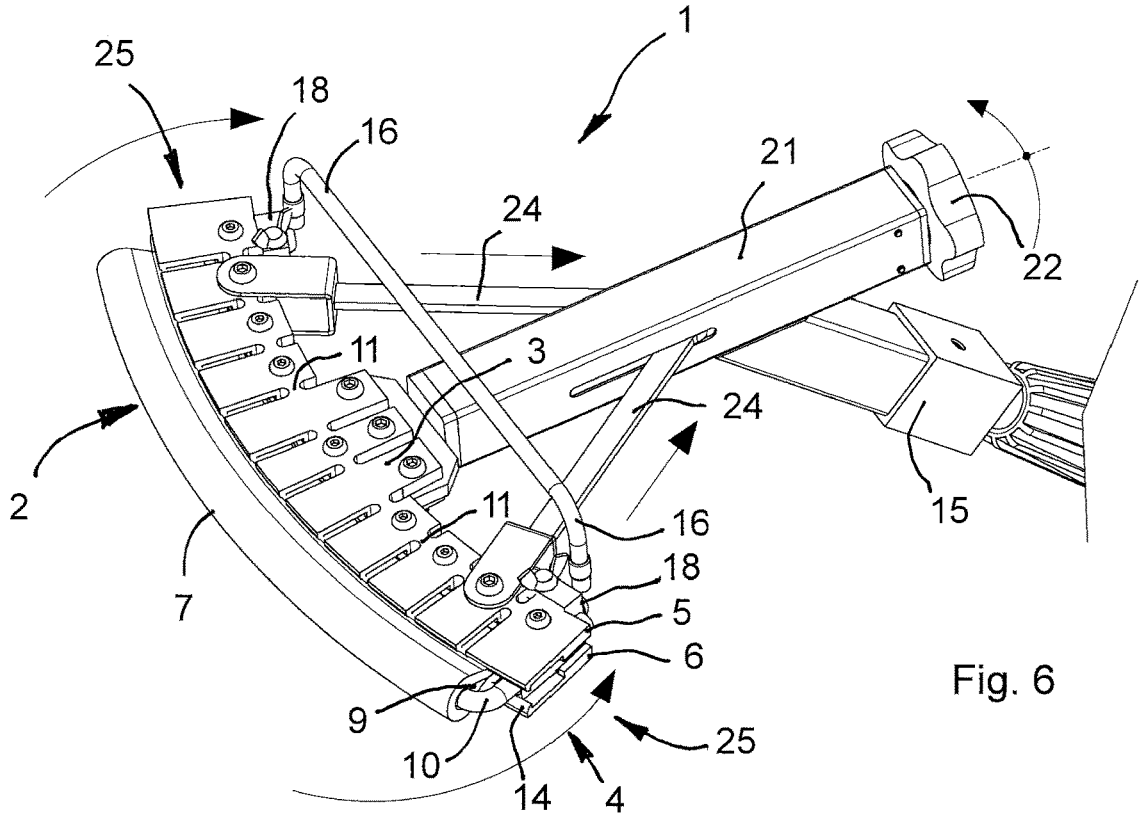
FIG. 6 shows a schematic perspective view of the doctor blade of FIG. 1 with the registration of the convex curvature, i.e., suitable for treating a concave surface.
Figure 7:
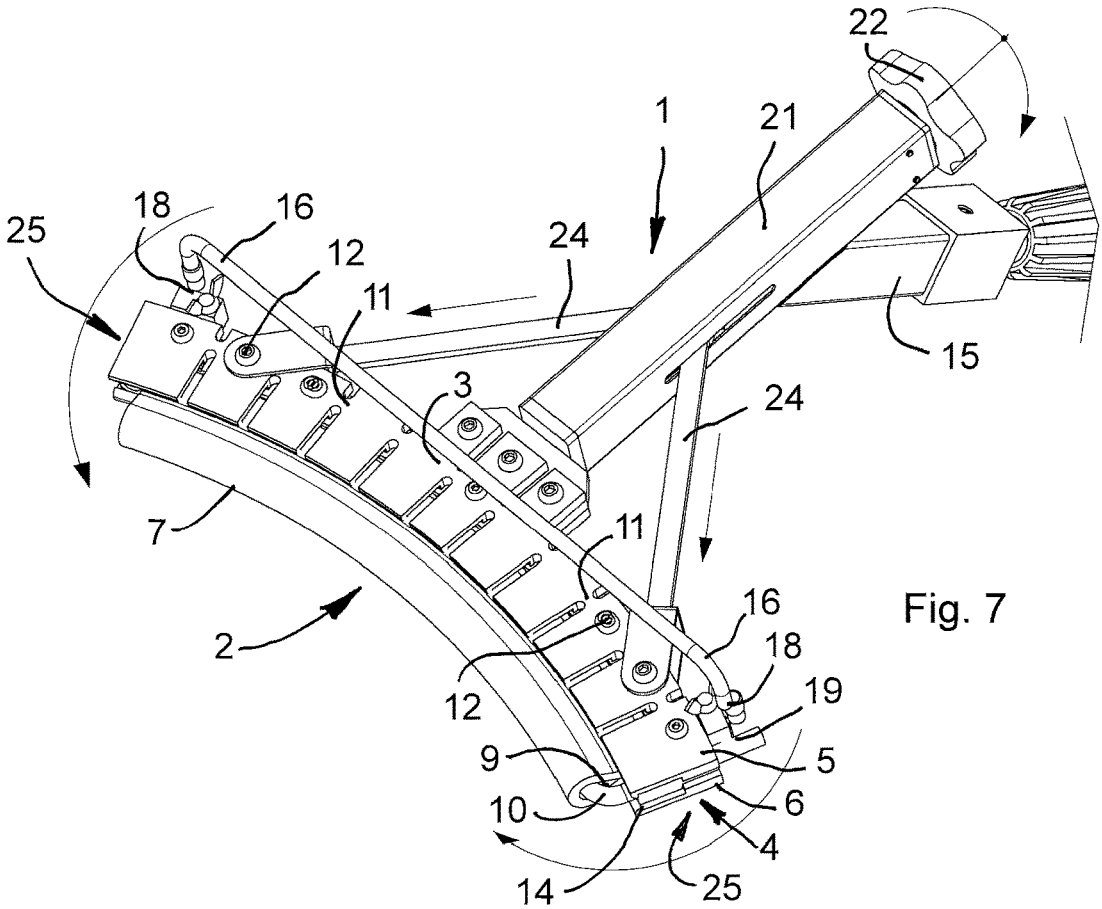
FIG. 7 shows a perspective and schematic view of the doctor blade of FIG. 1 with the registration of the concave curvature, i.e., suitable for treating a convex surface.
Figure 11:
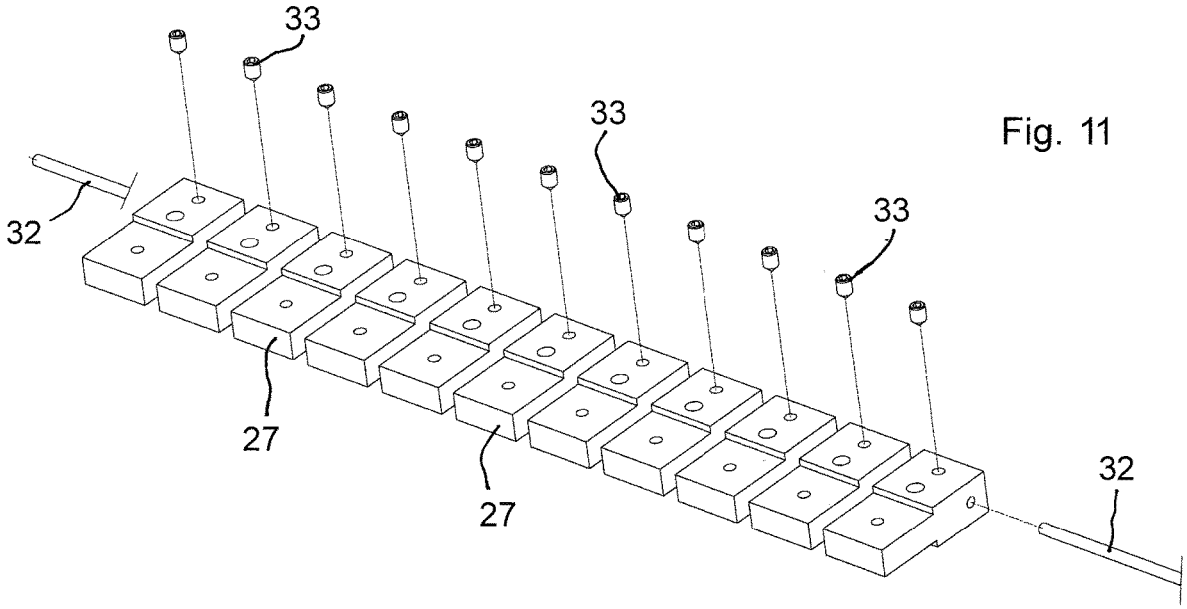
FIG. 11 shows a perspective and schematic view of the electrode having graphite elements when the conducting metal wire connecting the graphite elements is mounted.
Figure 12:
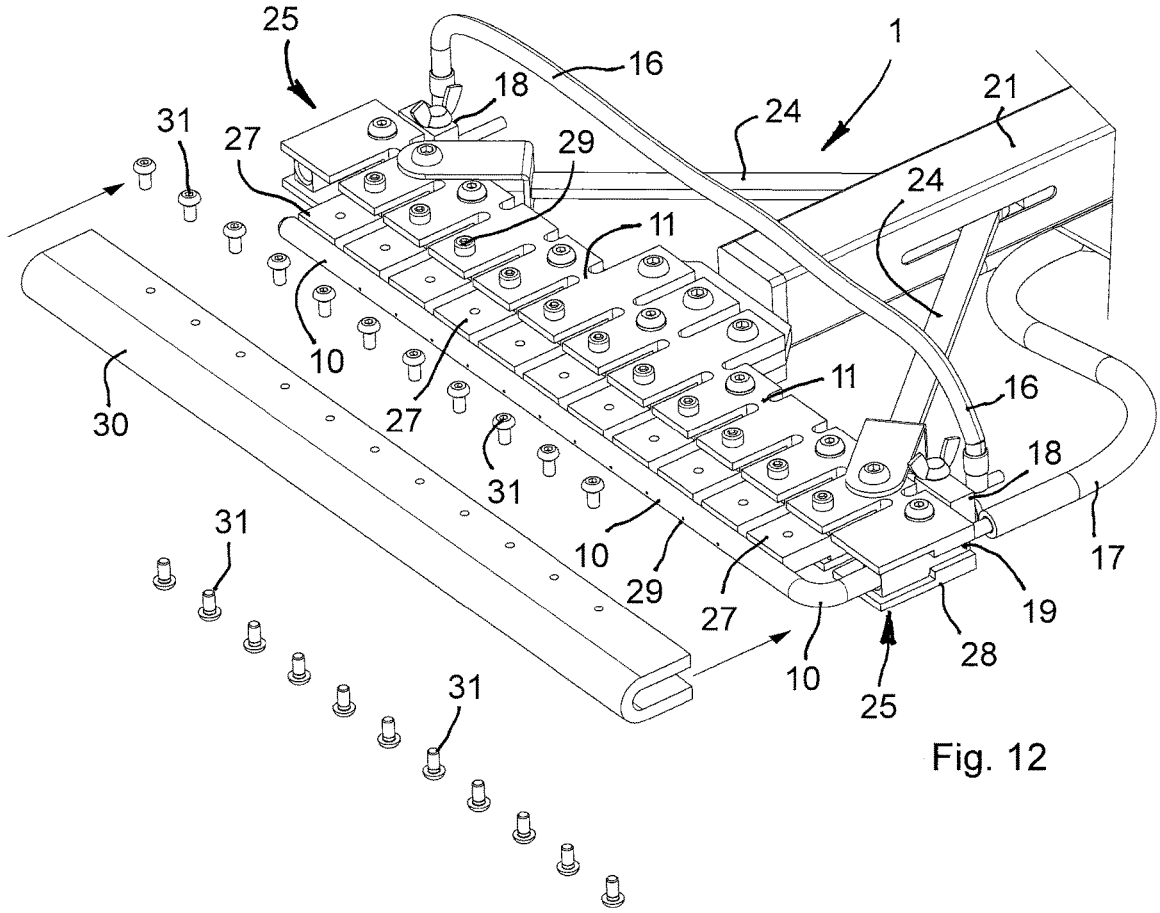
FIG. 12 shows a perspective and schematic view of the doctor blade with the electrode having graphite elements of FIGS. 8-10 when the pad is mounted.

The doctor blade 1 is deformed to form a convex curvature, as shown in FIG. 6, or a concave one, as shown in FIG. 7, by acting on a slider 20 housed within the rail 21, placed between the handle 15 and the deformable body 3 of the doctor blade, and adjusted while moving towards the rail or moving away from it by means of a knob 22 acting by rotation with a screw mechanism 23 on said slider 20; the slider is connected to push and/or pull rods 24 at the side ends 25 of the face of the doctor blade 1. As can be seen from the above figures, the curvature is made possible by the deformability of the pad 7, of the inner pipe 10, of the metal wire 8, of the deformable body 3 of the doctor blade on the connections 11 which takes place in the same face position F of the doctor blade, i.e., the elongations or compressions take place mainly on the outer surface of the pad 7 which is at a greater distance from the metal wire 8 located close to the direction of alignment of the tightening means 12 and the connections 11 between the clamping elements 4, forming the deformable body 3 of the doctor blade 1.

In FIGS. 8 to 12, a further form of graphite deformable electrode 26 is illustrated, in which graphite elements 27 are each fixed individually to the respective clamping elements 28; i.e., the graphite elements 27 being tightened, by means of tightening means 29, between the upper and lower clamping elements, which are not provided with teeth herein. A pad 30, soaked in an electrolytic solution, is fixed by means of removable elements 31 on the respective graphite elements 27 present in the graphite deformable electrode 26. The structure of the doctor blade 1 is similar to the doctor blade of the preceding FIGS. 1-7; each similar or identical part is hereinafter referred to with the same numbering. In this form of electrode, the metal wire 32 is inserted in the dedicated holes of each graphite element 27 which are fixed onto the wire, equally spaced, as much as the clamping elements 28 by means of removable fasteners 33. In this constructive form of the graphite deformable electrode 26, there is also the supply of electric current in the same way as in the preceding Figures, and the supply of electrolytic solution by means of an inner pipe 10 inserted between the front ends of the graphite elements 27 and the inner surface of the pad 30. The electrolytic solution is supplied in the same way as in the preceding constructive form.

Figure 15:
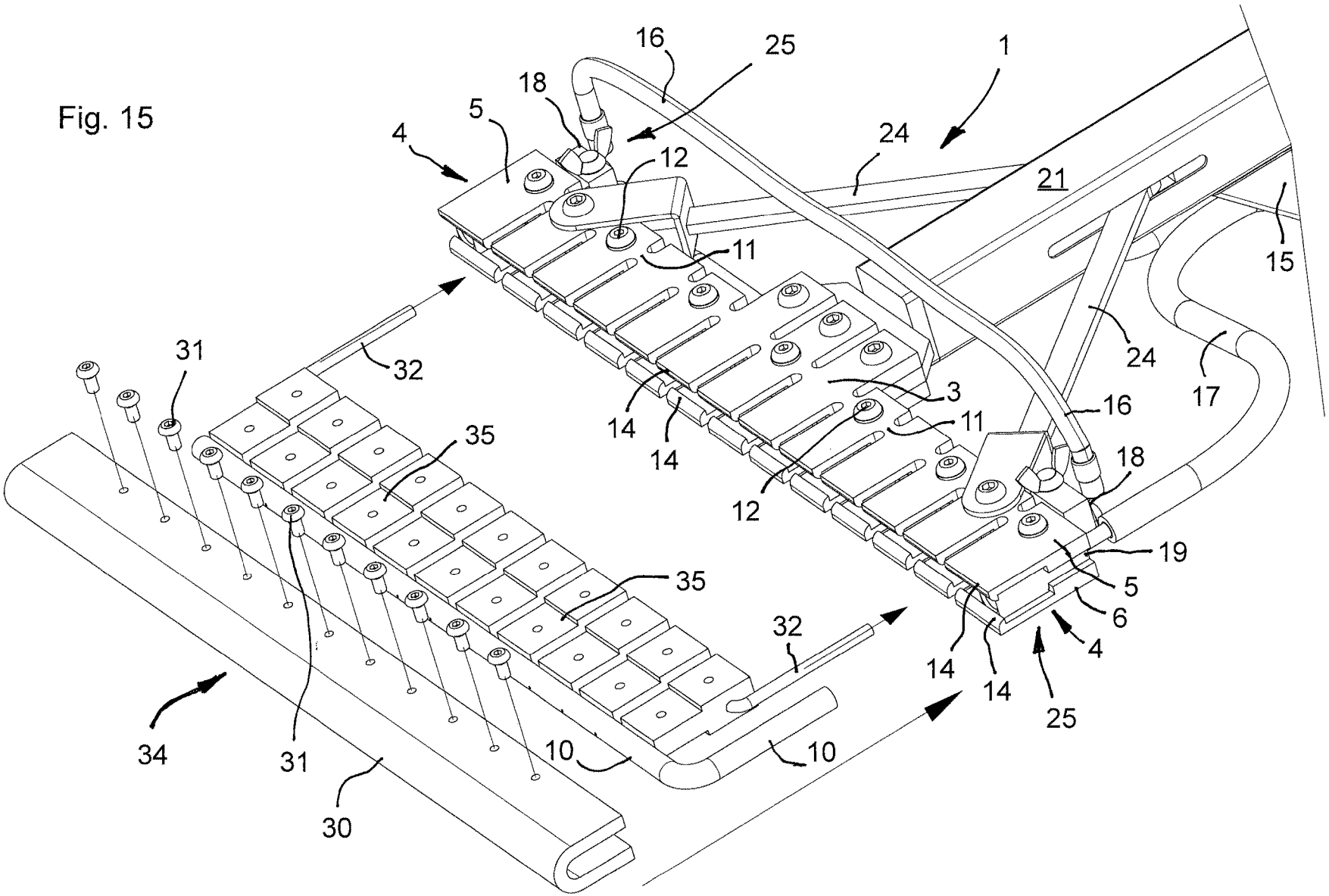
FIG. 15 shows a schematic perspective view of a doctor blade, just as FIGS. 1-5, with an electrode having graphite elements, made in the constructive form and during the assembly step of the electrode on the doctor blade and of the pad on the graphite elements.

A further constructive form, shown in FIGS. 13, 14, and 15, of deformable electrode 34 with graphite elements in which the graphite elements 35 are made similarly to the graphite elements 27, but are housed within the clamping elements 4 already present in the first constructive form of the doctor blade 1 described. The doctor blade 1 is made similarly to the doctor blade of FIGS. 1-7 and tightens each element of the graphite deformable electrode by means of the teeth 14 in each, both upper and lower, clamping element 4, i.e., this constructive form of deformable electrode 34 is interchangeable with the deformable electrode 2. It differs only in the conformation of the pad 30 soaked in the electrolytic solution which is fixed with removable elements 31 to each graphite element 35 of the graphite deformable electrode 34. The identical or similar parts of the preceding constructive forms are referred to with the same numbering, such as the metal wire 32 which, after having been tightened to each graphite element 35, is inserted into the terminals 18 of the doctor blade 1 in the same way as the metal wire 8.

In the described constructive forms of the deformable electrode, the metal wire 8, 32 is advantageously made of nickel, and the pads 7, 30 are made from a felt-like fabric made of a heat-resistant plastic material produced during the treatment and under the action of the chemicals present in the electrolytic solution used. Said plastic material is typically known as PEEK, the trade name of polyetheretherketone, or also as ZYLON, the trade name with the most suitable thickness of the pad in relation to the pickling effect to be achieved on the metal surface being treated.

The doctor blade according to the invention is used as described for the adjustment of the curvature of the doctor blade 1 by acting on the position of the slider 20 and of the ends 25 of the doctor blade with respect to the middle part of the doctor blade which is connected with the rail 21. After a deformable electrode has been mounted, the doctor blade may be moistened with the electrolytic solution fed into the deformable electrode through the pipe 10 and the holes 29 which it has in the section in contact with the pad 7 or 30. The doctor blade may also be equipped with non-deformable electrodes, but this does not diminish its innovative characteristics, this being a transient effect in that, as visible and manageable, the arched conformation of the doctor blade is one potential use, but the doctor blade 1 may still be used with the rectilinear face F for treating flat surfaces.

Besides, the presence of the pipe 10 for feeding the electrolytic solution is also optional. Actually, a fixed or deformable electrode 2, 26 or 34 may be made without having the pipe 10 for feeding the electrolytic solution: to exploit the electrolytic pickling action, the operator will have to dip the pad of the doctor blade in use in a tray or bucket, not shown, to cause the pad 7 or 30 itself to absorb the amount of electrolytic solution required to make the electrolytic action itself effective.

The advantages of using an electrolytically acting doctor blade for pickling and cleaning curved metal surfaces as described mainly result from the constitutive simplicity of the deformable electrode, both when it has the pad 7 and the braid 9 and in the versions of graphite deformable electrode 26 or 34, i.e., having the clamping elements 4 or 28 distributed in the direction of the face F of the doctor blade so as to make the alignment itself of the aforementioned clamping elements deformable. By displacing the alignment position of the ends 25 of the doctor blade 1 with respect to the middle part, the push or pull mechanism on the rods 24 gives to the position of the pad the convex, linear straight or even concave shape, and vice versa. The mechanism itself may be made differently from what has been described, but still suitable for moving forward (push) or backward (pull) the ends of the rods 24 connected to the slider sliding in the rail 21. The flexibility and deformability of the pad 7 or 30 allows the outer surface of the pad to achieve the required curvature of the face F of the doctor blade. In other words, the advantage that can be obtained is achieving the versatility of the face of the doctor blade 1 in adapting to the curvature most suited to the surface during a pickling or cleaning treatment, whether it is convex, planar or concave.

Obviously, a person skilled in the art, in order to satisfy specific and contingent requirements, may make numerous modifications to an electrolytically acting doctor blade for pickling and cleaning curved metal surfaces, as described above, by the way all falling within the scope of protection of the present invention as defined by the following claims.

The invention claimed is:

1. Electrolytically acting doctor blade for pickling and cleaning curved metal surfaces, comprising an electrode made with a metal wire around which a pad made of a felt-like absorbent plastic material, resistant to high temperatures and to the chemicals contained in the electrolytic solution used, is wrapped; gripping means of the doctor blade on the electrode over the length of the face (F) of the doctor blade; electrical connection of the ends of the metal wire by means of a power supply metal cable to initiate the electrolytic action; characterised in that the gripping means of the doctor blade on the electrode are connected to each other by the means placed alongside, in which the connection section, in the deformable body of the doctor blade which has been made pliable, is oriented towards the face (F) of the doctor blade; a push or pull mechanism acts on the ends of the doctor blade and, to obtain a reaction, with a middle part of the mechanism, connected to the middle part of the deformable body of the doctor blade, deforms the face of the doctor blade from rectilinear into the arched, convex or concave conformation, depending on the pull or push on the ends of the doctor blade, with respect to the middle part of the doctor blade, exerted by the said mechanism.

2. Electrolytically acting doctor blade, according to claim 1, wherein the push or pull mechanism is placed in the middle of the doctor blade and connected thereto, and has a rail in which a slider is made movable in the push or pull mechanism aligned with the rail; the slider is connected to each of the two ends of the doctor blade by means of rods having a predetermined length.

3. Electrolytically acting doctor blade, according to claim 2, wherein the slider of the push or pull mechanism is actuated by a screw mechanism with a manual gripping member in a position opposite to the connection between the rail of the slider and the middle part of the doctor blade.

4. Electrolytically acting doctor blade, according to claim 1, wherein a handle of the doctor blade is connected to the aforementioned rail of the slider and has a metal cable for the electrical connection to the said metal wire of the electrode.

5. Electrolytically acting doctor blade, according to claim 1, wherein there is an inner pipe for feeding the electrolytic solution in the electrode, on at least one end of the doctor blade there is a connection between the inner pipe and a pipe for supplying the electrolytic solution.

6. Electrolytically acting doctor blade, according to claim 1, wherein at both ends of the doctor blade, a terminal is provided to connect the end of the metal wire of the electrode to the electrical connection metal cable in at least one of them; from one end to the other of the doctor blade, there is an electrical connection metal cable acting as a U-bolt between the said terminals.

7. Electrolytically acting doctor blade, according to claim 1, wherein the gripping means of the doctor blade are tightened onto the electrode and have gripping teeth on the dorsal end of the electrode.

8. Electrolytically acting doctor blade, according to claim 1, wherein a carbon fibre braid in contact with the metal wire of the electrode and the inner surface of the pad is interposed between the pad and the metal wire of the electrode.

9. Electrolytically acting doctor blade, according to claim 1, wherein graphite elements, which are tightened onto the metal wire of the electrode and in contact with the inner surface of the pad, are interposed between the pad and the metal wire of the electrode.

10. Electrolytically acting doctor blade, according to claim 9, wherein the pad is fixed by removable elements on the graphite elements.

* * * * *